US007670174B2

(12) United States Patent
Yuan et al.

(10) Patent No.: US 7,670,174 B2
(45) Date of Patent: Mar. 2, 2010

(54) LOW PROFILE ELECTRICAL CONNECTOR

(75) Inventors: Wei Yuan, ShenZhen (CN); Yu-San Hsiao, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 38 days.

(21) Appl. No.: 12/004,976

(22) Filed: Dec. 21, 2007

(65) Prior Publication Data

US 2008/0153360 A1 Jun. 26, 2008

(30) Foreign Application Priority Data

Dec. 22, 2006 (CN) ..... 2006 2 0170613

(51) Int. Cl.
*H01R 13/60* (2006.01)

(52) U.S. Cl. ..... 439/570

(58) Field of Classification Search ..... 439/570, 439/569, 563, 573

See application file for complete search history.

(56) References Cited

U.S. PATENT DOCUMENTS 4,911,659 A * 3/1990 Viselli ..... 439/570
5,533,908 A * 7/1996 Henry et al. ..... 439/329
5,879,187 A * 3/1999 Cheng et al. ..... 439/570
6,132,248 A * 10/2000 Ramey ..... 439/570
6,159,044 A * 12/2000 Kita ..... 439/570
6,478,617 B2 * 11/2002 Fan ..... 439/570
6,579,122 B1 * 6/2003 Chen ..... 439/570
6,589,077 B1 * 7/2003 Wu ..... 439/567
6,755,671 B1 * 6/2004 Fan et al. ..... 439/108
7,390,216 B1 * 6/2008 Lee ..... 439/541.5
7,458,822 B2 * 12/2008 Ono ..... 439/74
7,488,208 B2 * 2/2009 Takahashi et al. ..... 439/570
2004/0219830 A1 * 11/2004 Fan ..... 439/570

* cited by examiner

*Primary Examiner*—Gary F. Paumen
(74) *Attorney, Agent, or Firm*—Wei Te Chung; Andrew C. Cheng; Ming Chieh Chang

(57) ABSTRACT

An electrical connector comprises an insulative housing, a plurality of terminals received in the insulative housing and a pair of retaining members assembled to the insulative housing. The insulative housing has a pair of positioning shoulders at two sides thereof, and each positioning shoulder defines a lower surface and a positioning hole extending there through. Each retaining member defines a main plate covering the lower surface of the positioning shoulder and a though hole corresponding to the positioning hole.

13 Claims, 4 Drawing Sheets

LOW PROFILE ELECTRICAL CONNECTOR

BACKGROUND OF THE INVENTION

1. Field of the Invention

The present invention relates to an electrical connector, and particularly to an electrical connector adapted for mounting on a print circuit board.

2. Description of the Related Art

With the rapid development of the technology of wireless communication and advanced technology of electrics, electrical connectors are designed to establish an electrical connection between a storage device and a print circuit board for high-speed signal transmission.

Usually, these electrical connectors each comprises an insulative housing, a shielding member assembled to the insulative housing, and a plurality of terminals received in the insulative housing. A conventional electrical connector comprises an insulative housing with a plurality of terminal passageways disposed therein and a plurality of terminals respectively received in the terminal passageways. The insulative housing has a pair of positioning portions. Each positioning portion forms a positioning hole. When the electrical connector is assembled to a print circuit board, a pair of bolts pass through corresponding holes defined on the print circuit board and the pair of positioning holes of the positioning portion to lock the electrical connector and the print circuit board together. However, these connectors are with compact structure to comply with the miniature trend. The positioning portions and positioning holes are of small sizes accordingly. Furthermore, the positioning shoulders are made of plastic materials. All of fore-mentioned factors cause the intension of the positioning shoulders are not enough and fragile to be damaged. In addition, the engagement between the electrical connector and the print circuit board are maintained only by the bolts. In other words, it means low efficient assembly.

Hence, an improved electrical connector is desired to overcome the disadvantages of the prior art.

BRIEF SUMMARY OF THE INVENTION

Therefore, a main object of the present invention is to provide an electrical connector adapted for mounting on a print circuit board.

To fulfill the above-mentioned object, an electrical connector comprises an insulatvie housing, a plurality of terminals received in the insulative housing and a pair of retaining members assembled to the insulative housing. The insulative housing has a pair of positioning shoulders at two sides thereof, and each positioning shoulder defines a lower surface and a positioning hole extending therethrough. Each retaining member defines a main plate covering the lower surface of the positioning shoulder and a though hole corresponding to the positioning hole.

Other objects, advantages and novel features of the invention will become more apparent from the following detailed description when taken in conjunction with the accompanying drawings.

BRIEF DESCRIPTION OF THE DRAWINGS

The foregoing summary, as well as the following detailed description of the embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF THE PREFERRED EMBODIMENT

Reference will now be made in detail to the preferred embodiment of the present invention.

Figure 1:
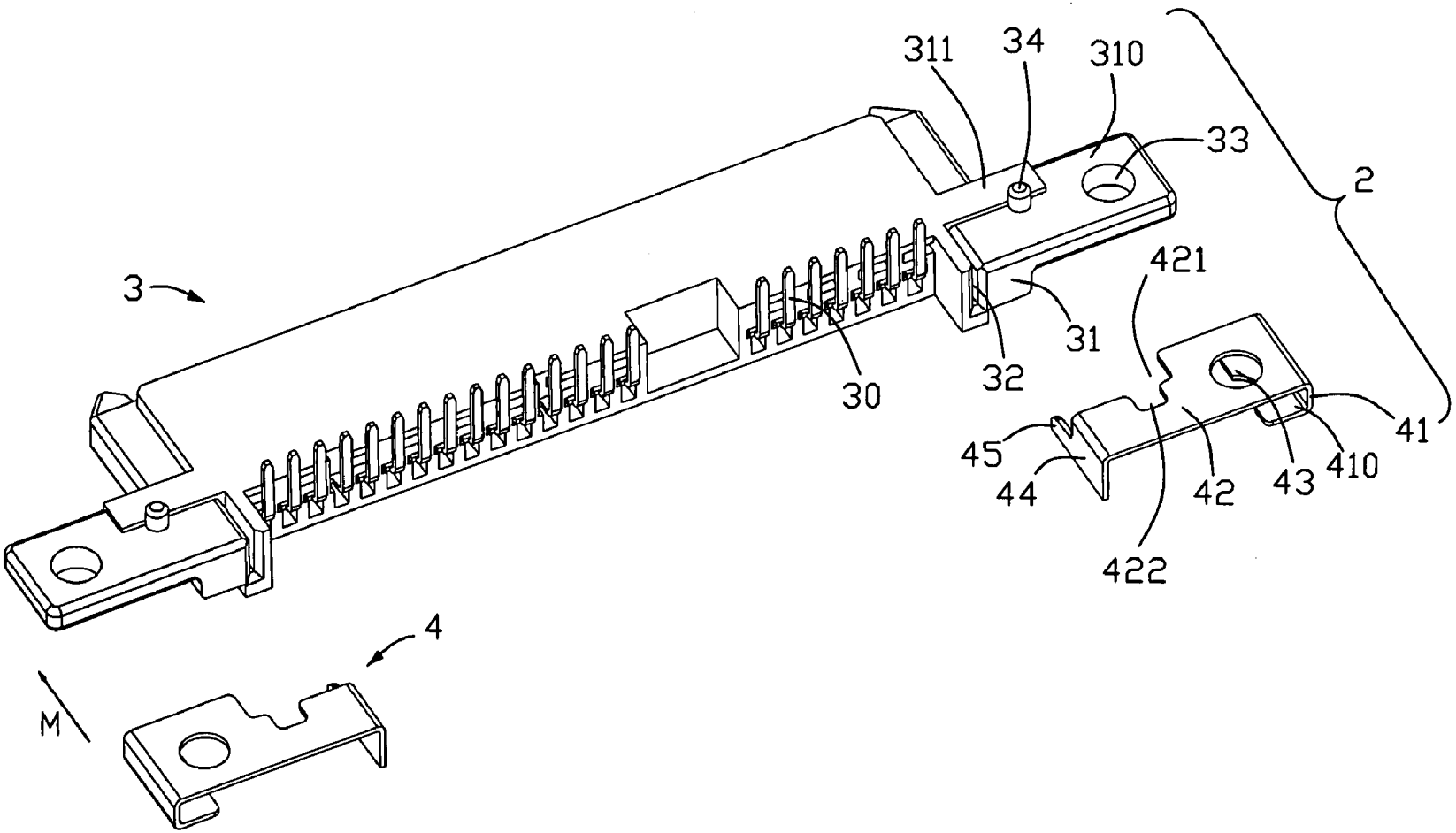
FIG. 1 is a partially exploded, perspective view of an electrical connector according to the present invention.
Figure 2:
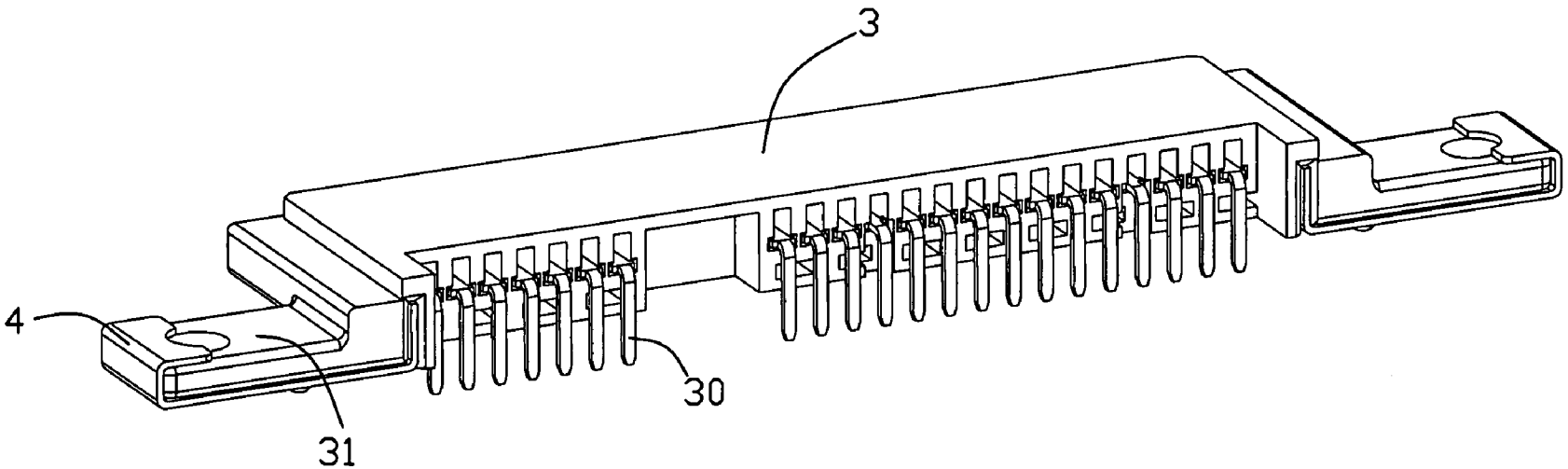
FIG. 2 is an assembled, perspective view of an electrical connector according to the present invention.
Figure 3:
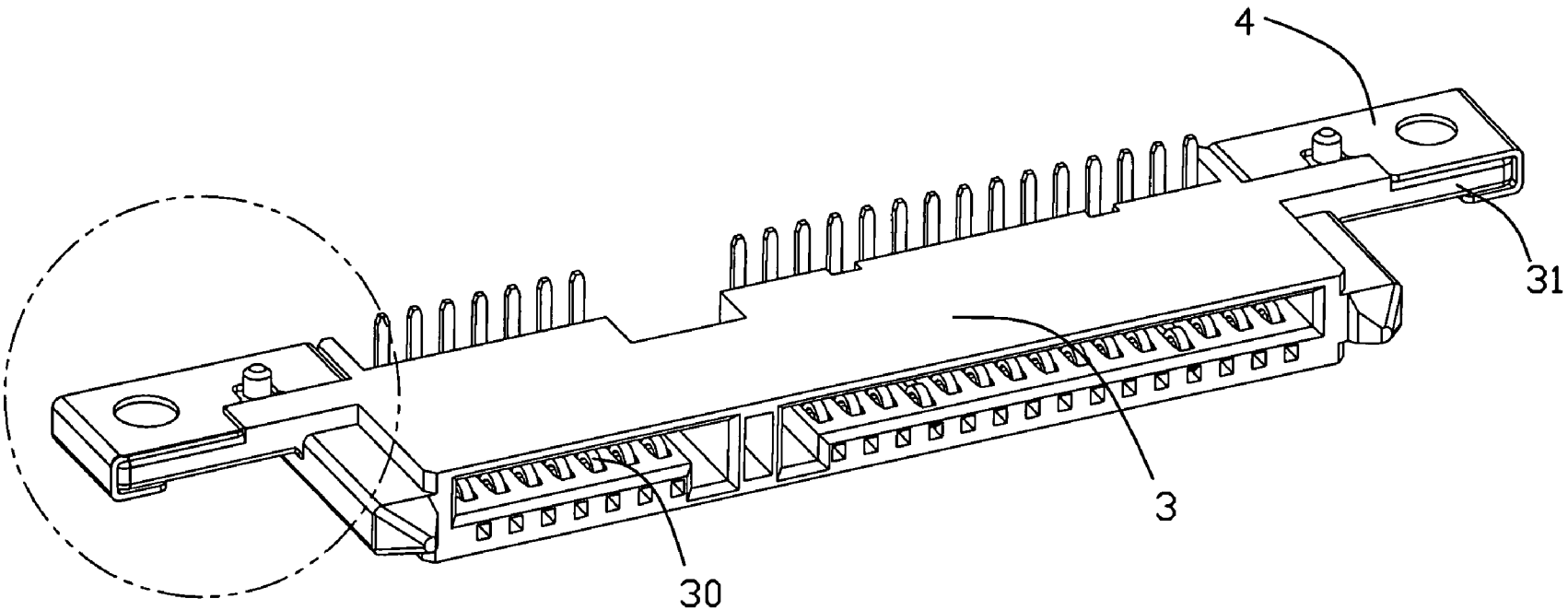
FIG. 3 is a view similar to FIG. 3, but viewed from another aspect.
Figure 4:
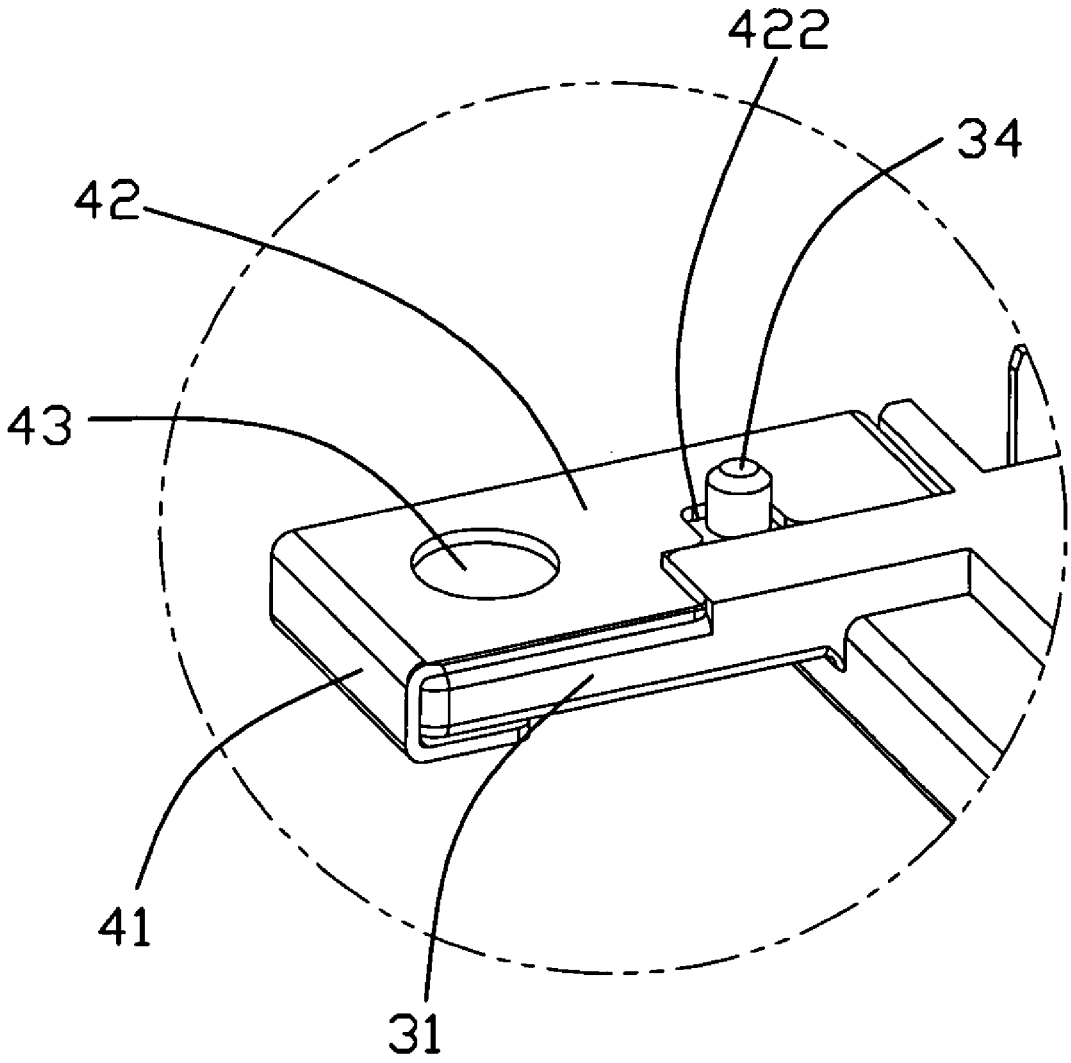
FIG. 4 is a partially enlarged view of FIG. 4.

Referring to FIGS. 2-5, an electrical connector 2 according to the present invention is adapted for electrically connecting a complementary connector (not shown) and a print circuit board (not shown). The electrical connector 2 comprises an insulative housing 3, a plurality of terminals 30 received in the insulative housing 3 and a pair of retaining members 4 assembled with the insulative housing 3.

The insulative housing 3 dimensioned to receive the plurality of terminals 30 therein has a pair of positioning shoulders 31. Each positioning shoulder 31 defines a lower surface 310, a bumping portion 311 downwardly extending from the lower surface 310, a post 34 downwardly extending from the lower surface 310 and adjacent to the bumping portion 311, a slit 32 disposed at one side thereof and upwardly extending from the lower surface 310 for limiting and retaining the retaining member 4 and a positioning hole 33 defined at another side thereof.

Each retaining member 4 is stamped from a metal plate, and then bent to form a rectangular configuration shown in the present invention. Each comprises a main plate 42 covering the lower surface 310 of the positioning shoulder 31, a side plate 44 bent from and perpendicular to the main plate 42 and a wrapping portion 41 bent from the main plate 42 and opposite to the side plate 44. The main plate 42 further defines a through hole 43 corresponding to the positioning hole 33, a cut-out 421 dimensioned to cooperate with the structure of the bumping portion 311 and a recess 422 communicating with the cut-out 421 and cooperating with the post 34. The wrapping portion 41 and the main plate 42 together form an U-shaped receiving slot 410 for cooperating with the positioning shoulder 31. The side plate 44 further defines a projecting portion 45 extending therefrom for reliable securing the engagement between the retaining member 4 and the positioning shoulder 31. In preferred embodiment, the height of the bumping portion 311 and the width of the slit 32 are all about same as the thickness of the metal plate.

In assembly, referring to FIGS. 2-5, firstly, the retaining members 4 are moved toward the positioning shoulder 3 along the M direction (shown in FIG. 2) with the side plates 44 inserting into the corresponding slits 32, the wrapping portions 41 engaging with the corresponding side portion of the positioning shoulder 31. Keep moving the retaining member 4, then after completing the assembly, each retaining member 4 is well cooperating with the positioning shoulder 31 with the side plate 44 retained in the slit 31, the main plate 42 covering the lower surface 310, the cut-out 421 cooperating with and stopped by the bumping portion 311 along the M direction, the recess 422 engaging with the post 34 for preventing the retaining member 4 from moving along a direction perpendicular to the M direction, the through hole 43 communicating with the positioning hole 33 and the receiving slot 410 accommodating the side portion of the positioning shoulder 31. The projecting portion 45 and the wrapping portion 41 are all capable of preventing the retaining member 4 from disengaging from the positioning shoulder 31 along a direction perpendicular to the lower surface 310.

In the preferred embodiment of the present invention, the retaining members 4 are not only capable of strengthening the intension of the positioning shoulder 31, but also providing an alternative engagement method between the positioning shoulder 31 and a print circuit board, such as a pair of blots or SMT (Surface Mounting Technology) adapting for different conditions. In addition, the thickness of the retaining member 4 is about same as the height of the bumping portion 311, therefore this design is facilitated to maintain the height of the total positioning shoulder 31.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing having a pair of positioning shoulders at two sides thereon, each positioning shoulder defining a lower surface and a positioning hole extending therethrough;

a plurality of terminals received in the insulative housing; and a pair of retaining members assembled to the pair of positioning shoulders, and each retaining member defining a main plate covering the lower surface of the positioning shoulder and a though hole corresponding to the positioning hole;

wherein each positioning shoulder defines a slit at one side thereof and extending upwardly from the lower surface, each retaining member defines a side plate extending from one side of the main plate and received in the slit;

wherein the retaining member defines a wrapping portion extending from another side thereof and opposite to the side plate;

wherein the wrapping portion and the main plate together form an U-shaped receiving slot for accommodating the positioning shoulder;

wherein each positioning shoulder defines a bumping portion extending from the lower surface, the main plate defines a cut-out rearwardly extending from one side thereof and dimensioned to adapt to the bumping portion.

2. The electrical connector as claimed in claim 1, wherein the thickness of the main plate is about same as the height of the bumping portion.

3. The electrical connector as claimed in claim 1, wherein each positioning shoulder defines a post extending downwardly from the lower surface.

4. The electrical connector as claimed in claim 3, wherein the main plate defines a recess communicating with the cut-out and accommodating the post.

5. An electrical connector comprising:

an insulative housing extending in a longitudinal direction with at least one receiving slot extending in a front-to-back direction perpendicular to said longitudinal direction;

a plurality of contacts disposed in the housing and exposed in the receiving slot;

a pair of guiding posts extending in the front-to-back direction and attached to two ends of the housing;

a pair of position shoulders integrally extending outwardly in said longitudinal direction at two ends of the housing; and a pair of metallic retaining members attached to the corresponding positioning shoulders; wherein each positioning shoulder is equipped with a post and a positioning hole, and the corresponding retaining member is equipped with recessed structures to comply with said post and said positioning hole.

6. The electrical connector as claimed in claim 5, wherein said retaining member includes a lance, one an inner side, retainably inserted into the housing, and an outer wrapping portion covering an exterior side edge of the corresponding shoulder.

7. The electrical connector as claimed in claim 5, wherein said shoulder cooperates with the corresponding post to form an L-shaped configuration.

8. The electrical connector as claimed in claim 5, wherein said shoulder are located behind a rear face of a main body of the connector.

9. The electrical connector as claimed in claim 5, wherein said retaining member includes portions essentially covering a bottom face of the corresponding positioning shoulder.

10. The electrical connector as claimed in claim 9, wherein the positioning shoulder defines a step on a bottom face thereof so as to compensate a thickness of the portion of the retaining member.

11. The electrical connector as claimed in claim 10, wherein said post is located closely adjacent to the step.

12. An electrical connector comprising:

a longitudinal insulative housing with a receiving slot therein along a longitudinal direction thereof and a pair of positioning shoulder integrally extending outwardly in said longitudinal direction at two ends of the housing;

a plurality of contacts disposed in the housing and exposed in the receiving slot and with soldering portion exposed in a mounting face of the housing; and a pair of metallic retaining members attached to the corresponding positioning shoulders; wherein each positioning shoulder defines a bumping portion around a front edge of the mounting face and a post downwardly projecting from the mounting face and intimately neighboring said bumping portion, and the corresponding retaining member is forwardly assembled to the housing from a rear face of the housing and defines a continuing rearwardly recessed portion to compliantly receive both the bumping portion and the post.

13. The electrical connector as claimed in claim 12, wherein the retaining member positioned on the mounting face is coplanar with the bumping portion.

* * * * *